United States Patent [19]

Baker et al.

[11] 4,364,625

[45] Dec. 21, 1982

[54] ELECTRICAL JACK ASSEMBLY

[75] Inventors: Paul A. Baker, Columbus; John W. Hoell, Reynoldsburg, both of Ohio

[73] Assignee: Bell Telephone Laboratories, Incorporated, Murray Hill, N.J.

[21] Appl. No.: 158,795

[22] Filed: Jun. 12, 1980

[51] Int. Cl.[3] ..... H01R 17/18

[52] U.S. Cl. ..... 339/183; 179/175.1 R

[58] Field of Search ..... 339/182, 183; 200/51.1, 200/51.11; 179/96, 97, 51 DA, 51 DB, 175.1 R, 175

[56] References Cited

U.S. PATENT DOCUMENTS

| | | | |
|---|---|---|---|
| 950,107 | 2/1910 | Larsson | 179/96 |
| 2,470,915 | 5/1949 | Bosh | 339/183 X |
| 4,165,147 | 8/1979 | Buck | 339/182 R |

*Primary Examiner*—Eugene F. Desmond

*Attorney, Agent, or Firm*—C. H. Davis

[57] ABSTRACT

An electrical jack is disclosed having an elongated non-conductive housing with a cylindrical opening for receiving a plug having tip, ring, and sleeve members. Corresponding tip, ring, and sleeve spring assemblies are positioned in the housing generally transverse to the cylindrical opening for engagement with the plug members and each assembly has a pair of break contacts which are opened to interrupt circuitry connected thereto, when the plug is fully inserted into the jack opening. The ring spring assembly is further arranged to engage the tip of the plug when the plug is partially inserted. The ring spring assembly positions the plug so that the tip and ring of the plug engage the ring and sleeve spring assemblies of the jack without opening the break contacts. Partial insertion of the plug permits bridging onto the circuit connected to the jack without interrupting the continuity of the circuitry connected through the break contacts.

14 Claims, 7 Drawing Figures

ELECTRICAL JACK ASSEMBLY

BACKGROUND OF THE INVENTION

This invention relates to electrical connectors and specifically to connectors commonly referred to as jacks. More specifically, this invention relates to jacks adapted for connection and mounting on a printed circuit board. In a still more specific aspect, this invention relates to a multifunction jack assembly for a printed circuit board.

In the prior art, jacks were designed for mounting on a printed circuit board to facilitate the connection of external apparatus to the printed circuit via a plug which was inserted into the jack. In the telephone communications industry, for example, test apparatus could be plugged into a printed circuit board jack to test a line, trunk, or miscellaneous circuit located thereon. In the case of line and trunk circuits, it is desirable to first determine if a customer is using the circuit before the circuit is interrupted for testing. This was accomplished in the prior art through the use of separate monitor and test jacks. More specifically, by inserting the test apparatus plug into the monitor jack, maintenance personnel could bridge onto the tip and ring transmission conductors of a line or trunk circuit and monitor for the presence of speech without interrupting a busy connection. If the circuit was found to be idle, the test equipment was then plugged into the test jack which divorced the line or trunk circuit from the tip and ring transmission conductors for test purposes.

While the prior art arrangement is wholly suitable for its intended purposes, it requires the use of multiple jacks with the accompanying increase in cost and space utilization.

DISCLOSURE OF THE INVENTION

The foregoing problem is solved and a technical advance is achieved by a jack arrangement capable of performing both monitor and test functions. More specifically, the jack comprises tip, ring and sleeve spring assemblies, each having a pair of break contacts and each assembly positioned to engage a correspondingly named member of a plug to open the break contacts when the plug is fully inserted into the jack. The ring and sleeve spring assemblies are further arranged to engage the tip and ring plug members, respectively, without opening the contacts when the plug is partially inserted.

More specifically, the ring spring assembly includes a spring element that extends into the opening for the plug and engages the plug tip when the plug is partially inserted. This spring element provides a positive force opposing the full insertion of the plug and positions the plug so that the ring and sleeve of the jack electrically engage the tip and ring, respectively, of the plug without opening the break contacts and disconnecting the circuitry coupled thereto. When the plug is fully inserted by overcoming the above force, the tip, ring and sleeve spring assemblies engage the corresponding tip, ring and sleeve of the plug and open their respective contacts to interrupt the associated circuitry.

Accordingly, if the jack arrangement is utilized on a printed circuit board having a trunk circuit thereon, the partial insertion of the test apparatus plug will permit maintenance personnel to monitor the trunk without interrupting the tip and ring transmission conductors. On the other hand, the full insertion of the test apparatus plug will separate the trunk circuit from its tip and ring transmission conductors to permit the testing of the trunk circuit.

DETAILED DESCRIPTION

While the invention can be utilized in many different jack arrangements, the invention is disclosed herein as an improvement to a jack similar to the jack disclosed in U.S. Pat. No. 4,165,147 to J. J. Buck of Aug. 21, 1979. It will be obvious to the reader, however, that other jack arrangements can be modified according to our teaching to perform the monitor and test functions within the spirit and scope of the invention set forth herein.

Figure 1:
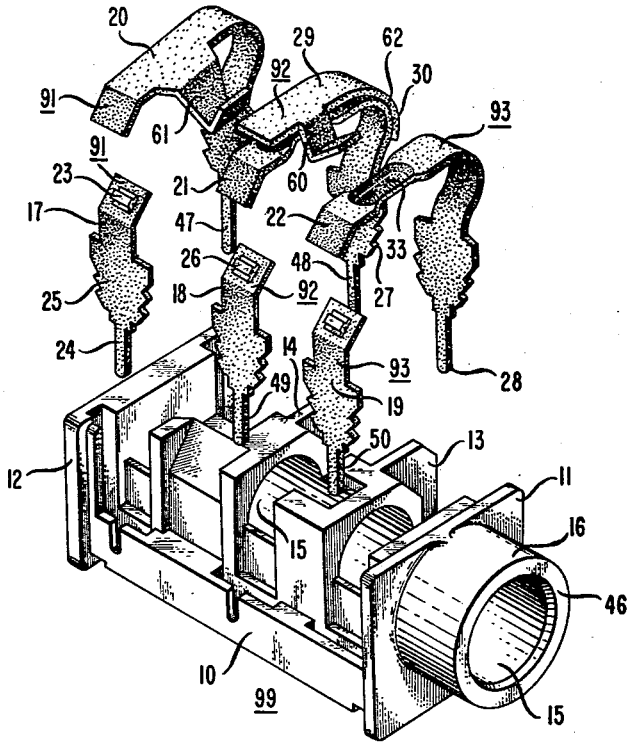
FIG. 1 is an exploded pictorial view of a typical jack assembly employing the invention.

FIG. 1 shows an exploded pictorial view of the jack assembly generally designated 99 which comprises a housing having a base 10, front and rear walls 11 and 12 with intermediate walls 13 and 14. The cylindrical opening 15 extends substantially the length of the jack housing through the intermediate walls 13 and 14 to accompany a plug, such as plug 80 shown in FIGS. 2, 4, and 5. Base 10, which is made of insulating material, is adapted to receive a plurality of break contact assemblies generally extending transverse to the opening 15. In the illustrative embodiment, three contact spring assemblies referred to herein as the tip assembly 91, ring assembly 92, and sleeve assembly 93 are provided. Each contact assembly comprises a fixed spring contact element, such as element 17, and a movable spring contact element, such as 20, both of which are part of the tip contact assembly 91. Each contact element includes a shaft with an appropriate barbed portion, such as 25, for insertion and retention within a corresponding slot of base 10.

Each stationary contact element also includes a contact surface, such as bar contact 23, affixed to element 17. A similar bar contact surface is affixed to the underside of each of the movable spring elements 20–22. When the contact elements 17–19 and 20–22 are retained in their appropriate slots in base 10, the bar contacts of each movable spring element are in physical engagement with the bar contacts of the associated stationary member, as shown in FIG. 3, to provide an electrical path through the contact pair.

Figure 2:
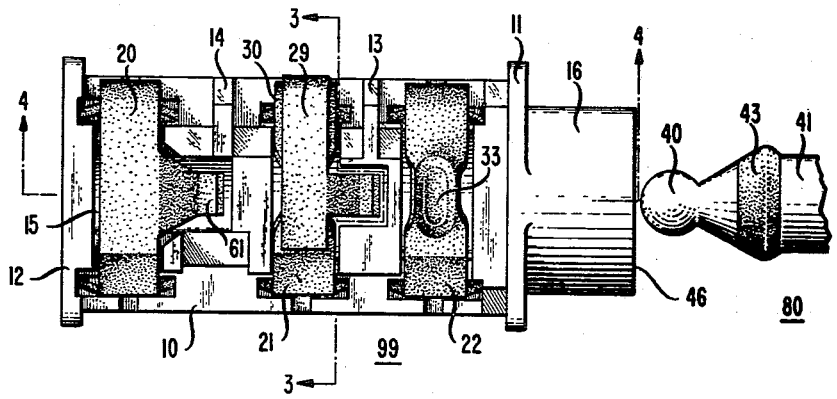
FIG. 2 is a top plan view of the jack assembly shown in FIG. 1.
Figure 3:
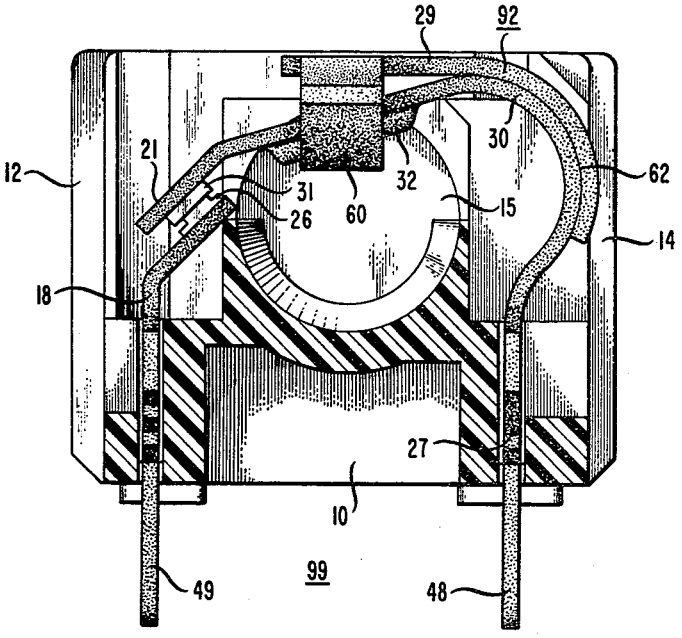
FIG. 3 is a sectional view of the jack assembly as viewed along section line 3—3 of FIG. 2.

The specific construction of a break contact spring assembly is best illustrated in FIGS. 1 and 3 with FIG. 3 being a cross-sectional view of the ring spring assembly 92 taken perpendicular to the center line of the cylindrical opening 15 along the section line 3—3 depicted in FIG. 2. As shown, the movable spring element 21 is mounted in a cantilevered manner with respect to base 10 with its barbed portion 27 extending into base 10 and its shaft or lug portion 48 extending below the base in order to receive an electrical connection in a well known manner.

The curved portion 30 of movable spring 21 is designed to provide a sufficient contact force between contact bars 26 and 31 to provide a low electrical resistance when contacts 26 and 31 are in physical contact with plug 80 removed.

Each of the movable springs 21 and 22 is provided with a ribbed portion, such as the ribbed portion 32 of spring 21 as shown in FIG. 3. The ribbed portion 32 extends across the cylindrical opening 15 to contact the ring member of the plug 80 when the plug is fully inserted. Similarly, the ribbed portion 33 of the movable sleeve spring engages the sleeve member of the plug when the plug is fully inserted. These ribbed portions also insure better electrical contact with their respective plug members and provide additional rigidity to that portion of the movable springs.

Upon insertion of a plug into the cylindrical opening 15, the ribbed portion 32 is contacted by the plug causing an upward movement of spring 21, thereby opening the break contacts 26 and 31 to interrupt any electrical circuit coupled to lugs 48 and 49.

Figure 4:
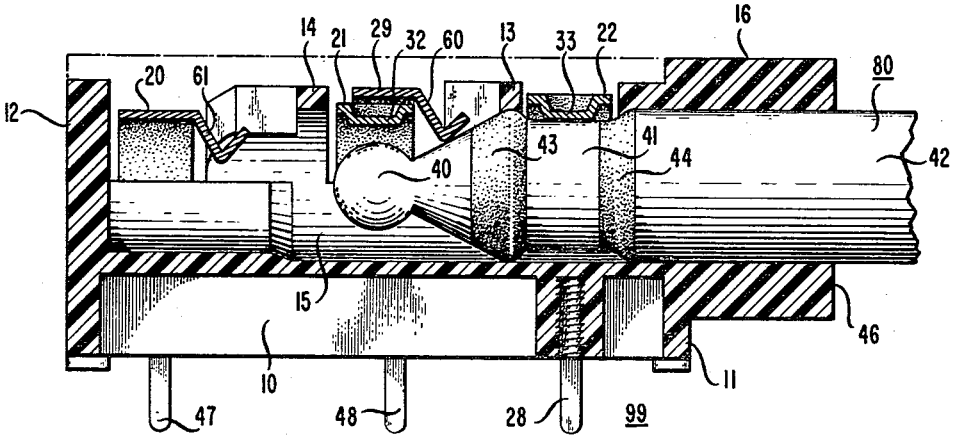
FIG. 4 is a sectional view of the jack taken along section line 4—4 of FIG. 2 showing the jack with a plug partially inserted therein.
Figure 5:
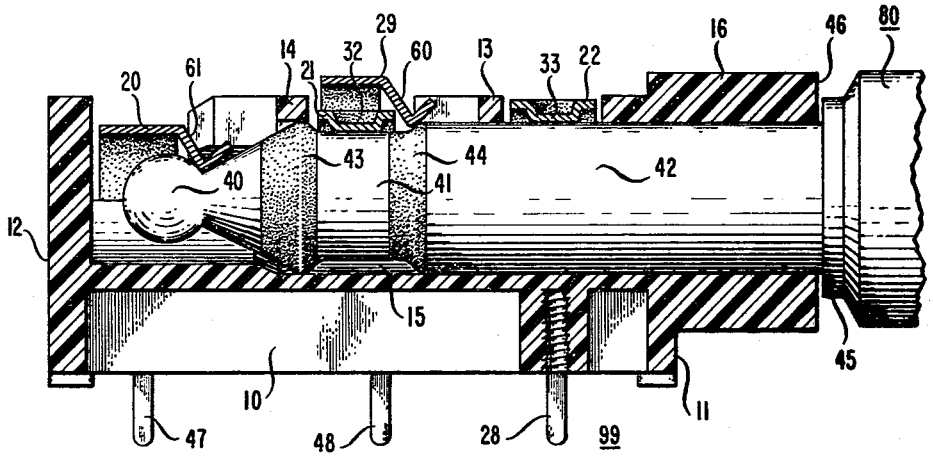
FIG. 5 is similar to FIG. 4 but shows the jack assembly with the plug fully inserted.

Movable tip spring element 20, as seen in FIGS. 1, 2, 4, and 5, has a generally V-shaped portion 61 which engages the tip member of the plug when the plug is fully inserted in cylindrical opening 15. This V-shaped portion also causes the movable tip spring element 20 to move upward thereby opening the break contacts associated with the tip spring assembly 91. The V-shaped portion 61 also tends to retain plug 80 within the jack assembly when the plug has been fully inserted therein as shown in FIG. 5.

Movable ring spring element 21 is provided with an additional spring element 29 having a generally V-shaped portion 60. In the illustrative embodiment, spring element 29 is fastened to spring 21 in the vicinity of area 62 in such a manner as to allow spring 29 to be positioned independently of spring 21. Thus, the movable spring element 29 can make electrical contact with a plug member without opening the break contacts 26 and 31 associated with the ring spring assembly 92. Of course, it is recognized as being within the spirit and scope of the invention that spring 29 could be independently mounted in the housing such that spring 29 can be independently positioned with respect to spring 21.

FIGS. 4 and 5 each show the side view section of the jack taken along section line 4—4 which coincides with the centerline of cylindrical opening 15. FIG. 4 shows the jack with a partially inserted plug in what will be referred to herein as the "monitor" position while FIG. 5 shows a fully inserted plug in what will be referred to herein as the "test" position.

The plug 80 comprises three electrically conductive members designated tip 40, ring 41 and sleeve 42. Tip 40 is electrically insulated from ring 41 by insulator 43, while ring member 41 is insulated from sleeve 42 by insulator 44.

The operation of the jack will now be described. In its normal position with plug 80 removed, the contact bar on movable spring element 20 is an electrical engagement with contact bar 23 on fixed contact element 17 thereby electrically connecting lugs 24 and 47 (FIG. 1). Similarly, lugs 48 and 49 of ring spring assembly 92 in FIGS. 1 and 3 are electrically connected and lugs 28 and 50 of sleeve spring assembly 93, shown in FIG. 1, are electrically connected.

When a plug is partially inserted into the jack assembly, as shown in FIG. 4, the V-shaped portion 60 of ring spring element 29 electrically engages the tapered portion of plug tip member 40. V-shaped portion 60 applies a force to the plug to restrain the plug from further insertion into the jack without the application of additional force. Although spring element 29 may move with respect to spring element 21, the break contacts 26 and 31 of the ring spring assembly remain in contact with each other so as not to interrupt the circuit connected to lugs 48 and 49. In this position, called the monitor position, the ribbed portion 33 of sleeve spring element 22 electrically engages the ring member 41 of plug 80 and the sleeve member 42 of the plug engages the insulated wall 16 of cylindrical opening 15.

Figure 6:
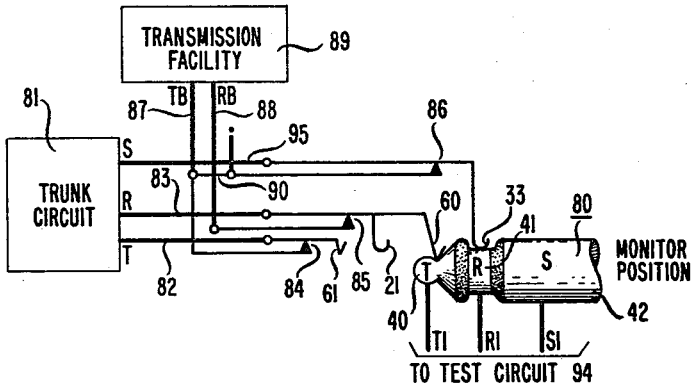
FIGS. 6 and 7 show a schematic representation of the jack when used in a typical communication system.
Figure 7:
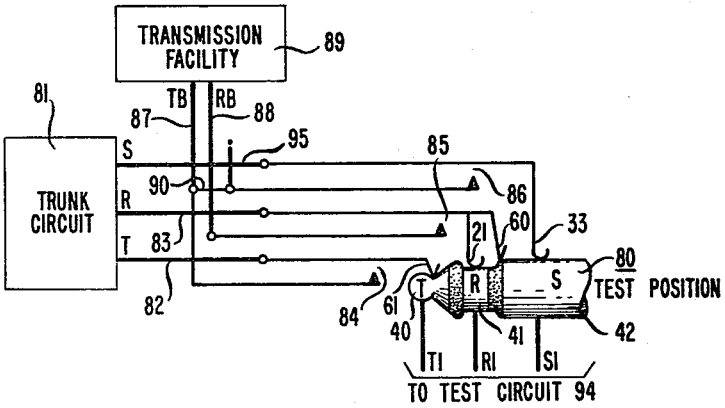

FIG. 6 is a schematic diagram equivalent to FIG. 4 and shows the jack assembly used in a typical communications application. More specifically, trunk circuit 81 has its tip and ring transmission conductors 82 and 83 connected through normally closed (i.e., break) contacts 84 and 85, respectively, to transmission conductors 87 and 88 which connect to transmission facility 89. Transmission facility 89 can be a carrier system or metallic cable as is well known in the art and need not be detailed herein for an understanding of the invention. Tip transmission conductor 87 is also connected via conductor 90 to break contacts 86. The pairs of break contacts designated 84, 85, and 86 in FIGS. 6 and 7 correspond to the contacts of the tip, ring and sleeve spring assemblies 91, 92, and 93, respectively, as described above with reference to FIGS. 1–5.

It will be noted in FIG. 6 that the tip member 40 of plug 80 which extends to test circuit 94 is electrically connected via V-shaped portion 60 of the ring spring assembly 92 to ring conductors 83 and 88 without opening contacts 85 to interrupt these conductors. Similarly, ring member 41 of the plug is electrically engaged with the ribbed portion 33 of spring 22 to bridge onto the tip conductors 82 and 87 via conductor 90 without interrupting conductors 82 and 87. Thus, test circuit 91 can be bridged onto the transmission conductors of the trunk to monitor the trunk for speech and thereby ascertain the busy condition of the trunk without interrupting service.

Turning now to FIG. 5, it can be seen that when plug 80 is fully inserted in the jack assembly as determined by plug shoulder 45 engaging surface 46 of the cylindrical opening 15, the tip 40, ring 41 and sleeve 42 members of the plug are engaged with their respective spring elements 20, 21 and 22. Also, the V-shaped portion 60 of spring element 29 engages insulator 44 between the ring and sleeve members of the plug. Looking at the schematic diagram of FIG. 7 which is a circuit equivalent of the sectional view in FIG. 5, it can be seen that the tip, ring and sleeve plug members are engaged with the tip, ring and sleeve conductors 82, 83 and 95, respectively, of the trunk circuit 81 to permit testing of the trunk by test circuit 94. Also, contacts 84, 85 and 86 are fully open at this time disconnecting the trunk circuit 81 from transmission facility 89.

Of course, it will be understood that the arrangement described in the foregoing is merely illustrative of the application and principles of the present invention. Numerous other arrangements may be utilized by those skilled in the art without departing from the spirit and scope of the invention. For example, suitable arrangements for the monitor-test feature can be incorporated in jack assemblies having different spring configurations. Also, the specific shapes and positions of the springs shown herein might be altered to suit a particular need as long as ring and sleeve spring assemblies on the jack are suitably provided to engage the tip and ring plug members when a plug is partially inserted and provide a noticeable restraining action against the full insertion of a plug in order to position the plug in the monitor position.

We claim:

1. An electrical jack adapted to receive a plug having tip, ring and sleeve members, said jack comprising tip, ring and sleeve spring assemblies each including a pair of break contacts;

said ring spring assembly also including a first and second movable spring element in electrical engagement with each other and a stationary spring element in electrical engagement with said first spring element when said plug is removed from said jack; and each assembly positioned to engage a correspondingly named plug member to actuate said contacts when said plug is fully inserted into said jack; and one of said movable ring spring elements adapted to engage said plug tip member and said sleeve spring assembly adapted to engage said plug ring member while maintaining said contacts closed when said plug is partially inserted in said jack.

2. The invention defined in claim 1 wherein said jack also includes a base of insulating material and wherein said movable spring elements include means for mounting said movable spring elements on said base to permit each of said first and second spring members to move independently of each other.

3. An electrical jack comprising an elongated nonconductive housing having a generally cylindrical opening therein along a longitudinal axis for insertion of a plug member;

a first and a second contact assembly each mounted in said housing extending generally transverse to said cylindrical opening; each said contact assembly comprising a first contact element mounted in a cantilevered manner in said housing and having a contact portion extending transversely across said cylindrical opening for electrical engagement with a portion of said plug member when inserted therein, said first contact element further including a free end movable between a first and second position in response to insertion and removal, respectively, of said plug member, and a second contact element mounted in a cantilevered manner in said housing and having a free end, each of the free ends of said first and second contact elements including contact surfaces for electrical engagement with each other when the free end of said first contact element is in its second position; and said first contact assembly also including a conductive spring element electrically connected to the corresponding first contact element of said first contact assembly and mounted in a cantilevered manner extending generally transversely across said cylindrical opening, said spring element having a free end movable between first and second positions independently of the corresponding first contact element in response to insertion and removal, respectively, of said plug member, said spring element also including a contact portion for electrical engagement with a portion of said plug member when inserted therein, the contact portion of said spring element in its second position being nearer the center line of said opening than the contact portion of said corresponding first contact element in its second position to electrically engage a portion of said plug member when inserted therein while maintaining said corresponding first contact element in said second position.

4. The invention defined in claim 3 wherein the contact surfaces of said first contact assembly are electrically connected when the free end of said first contact element is in its second position and the free end of said spring element is in one of its first and second positions and wherein said contact surfaces of said first contact assembly are electrically disconnected when the free end of said first contact element is in its first position.

5. The invention defined in claim 3 wherein the contact portion of said spring element comprises a V-shaped tab extending into said cylindrical opening.

6. An electrical jack for use with a plug having tip, ring and sleeve members adjacently mounted in a fixed relationship along a common axis; said jack comprising an elongated nonconductive housing having a generally cylindrical opening therein along a longitudinal axis for receiving said plug; and tip, ring and sleeve contact assemblies each having a first spring element mounted in said housing for engagement with the correspondingly named plug member when the plug is fully inserted in said opening, the spring elements being movable between actuated and released positions in response to the full insertion and removal, respectively, of said plug;

each said contact assembly also including a fixed spring element associated with said first movable spring element, each said spring element having a contact surface wherein the contact surfaces of associated fixed and movable spring elements are in electrical engagement when the movable one of the associated first spring elements is in its released position and said contact surfaces are disengaged when said movable spring elements are in said actuated position;

and said ring contact assembly further comprising a second movable spring element positioned to electrically engage said plug tip member when said plug is partially inserted in said opening and said plug ring member is electrically engaged with said first sleeve spring element in its released position.

7. The invention defined in claim 6 wherein each said first movable spring element also includes a first lug portion for connection to a first circuit, wherein each said fixed spring element also includes a second lug portion for connection to a second circuit, wherein said first and second lug portions are electrically connected together when said plug is removed from said jack opening and electrically disconnected when said plug is fully inserted in said opening.

8. The invention defined in claim 6 wherein said second spring element is connected to the associated movable first spring element, and wherein said second spring element comprises a movable end positioned within said opening to electrically engage the plug tip member without actuating said first movable ring spring element.

9. The invention defined in claim 6 wherein said second movable spring element comprises a tab portion positioned within said opening to apply a force to said plug tip member to oppose the insertion of said plug.

10. The invention defined in claim 9 wherein the ring member is mounted between said tip and sleeve members along said plug axis, wherein said plug also comprises electrical insulators separating adjacent ones of said plug members, wherein said plug tip member includes a tapered portion, and wherein said spring tab includes a V-shaped conductive member positioned to engage said tapered portion when the plug is partially inserted to provide a force along said plug axis and positioned to engage one of said insulators when said plug is fully inserted.

11. A multipurpose electrical jack for selectively interconnecting first and second circuits with a third circuit via a plug connected to said third circuit, said jack comprising a generally nonconductive housing having a cylindrical opening therein along a longitudinal axis for receiving said plug;

tip, ring and sleeve assemblies mounted in said housing and each having a movable spring element connected to said first circuit, said spring elements located in respective tip, ring and sleeve positions in said opening to engage a correspondingly named plug member when said plug is fully inserted therein, each said spring element being actuated only when engaged with its corresponding plug member and released in response to the disengagement of said plug member from its corresponding spring element;

each said assembly also including a fixed contact element coupled to said second circuit and positioned to electrically engage said corresponding spring element when said spring element is released thereby to interconnect said first and second circuits and to disconnect said first and second circuits when said spring element is actuated; and an auxiliary spring element electrically connected to said movable ring spring element and located within said opening at said ring position, said auxiliary spring element including a portion for engaging said plug tip member when said plug ring member is engaged with said sleeve spring element whereby said third circuit is connected to said first and second circuits while maintaining the connection between said first and third circuits.

12. The invention defined in claim 11 wherein the engaging portion of said auxiliary spring element comprises a generally angular-shaped tab for positioning said plug in said cylindrical opening to permit said plug ring member to make electrical contact with said movable sleeve spring element while maintaining said sleeve spring element released.

13. The invention defined in claim 12 wherein additional circuit means are provided to interconnect the fixed contact elements of said tip and sleeve assemblies.

14. The invention defined in claim 12 wherein each said spring element includes means for mounting said spring element in a cantilevered manner to permit actuation of each spring element independently of said other spring elements.

* * * * *